US011267604B2

(12) United States Patent
Solanki et al.

(10) Patent No.: US 11,267,604 B2
(45) Date of Patent: Mar. 8, 2022

(54) ROBOTIC LABELING SYSTEM AND METHOD OF LABELING PACKAGES

(71) Applicant: TE Connectivity Services GmbH, Schaffhausen (CH)

(72) Inventors: Swapnilsinh Solanki, Harrisburg, PA (US); Du Wen, Reading, PA (US); Jiankun Zhou, Mechanicsburg, PA (US); Roberto Francisco-Yi Lu, Bellevue, WA (US)

(73) Assignee: TE Connectivity Services GmbH

( * ) Notice: Subject to any disclaimer, the term of this patent is extended or adjusted under 35 U.S.C. 154(b) by 0 days.

(21) Appl. No.: 16/934,299

(22) Filed: Jul. 21, 2020

(65) Prior Publication Data

US 2022/0024629 A1 Jan. 27, 2022

(51) Int. Cl.

| | |
|---|---|
| ***B65C 9/40*** | (2006.01) |
| ***B65C 1/02*** | (2006.01) |
| ***B65C 9/26*** | (2006.01) |
| ***B65C 9/46*** | (2006.01) |
| ***B65C 9/02*** | (2006.01) |

(52) U.S. Cl.

CPC ..... *B65C 9/40* (2013.01); *B65C 1/021* (2013.01); *B65C 9/02* (2013.01); *B65C 9/26* (2013.01); *B65C 9/46* (2013.01); *B65C 2009/401* (2013.01)

(58) Field of Classification Search

CPC .. B65C 1/021; B65C 9/02; B65C 9/04; B65C 9/06; B65C 9/26; B65C 9/40; B65C 9/44; B65C 9/46; B65C 2009/401; B65C 2009/407; B65C 2009/408

See application file for complete search history.

(56) References Cited

U.S. PATENT DOCUMENTS

| | | | | |
|---|---|---|---|---|
| 4,425,181 | A * | 1/1984 | Bahr | B65C 3/14 156/497 |
| 2013/0174960 | A1* | 7/2013 | Goetz | B65C 3/00 156/64 |
| 2015/0225104 | A1* | 8/2015 | Reed | B65B 61/26 347/110 |
| 2016/0052659 | A1* | 2/2016 | Bowers | B65C 1/021 156/64 |
| 2018/0265239 | A1* | 9/2018 | Riva | B65C 1/021 |

* cited by examiner

*Primary Examiner* — George R Koch

(57) ABSTRACT

A robotic labeling system includes a package locating system and a package identification system identifying a package orientation. The robotic labeling system includes a label application system having first and second label printers and first and second label applicators. The label printers are both capable of printing a shipping label and a customer specific label. The first label applicator applies a first label (either the shipping label or the customer specific label) to a first side of the package while the second label applicator applies a second label (other of the shipping label or the customer specific label) to a second side of the package different than the first side. The printing and application of the labels is based on the orientation of the package.

20 Claims, 4 Drawing Sheets

ROBOTIC LABELING SYSTEM AND METHOD OF LABELING PACKAGES

BACKGROUND OF THE INVENTION

The subject matter herein relates generally to package labeling systems and methods.

Package labeling is a manual process at many warehouses and distribution centers. The manual labeling process relies on operators to determine the location where the labels need to be applied. Manual labeling processes have high labor costs, are subject to human error, and are time consuming to apply the labels. Additionally, labels applied manually to packages may be at improper or unwanted positions and may be applied inconsistently from package to package. Some known automated labeling systems are in use in warehouses and distribution centers. However, conventional labeling systems use simple labeling methods to apply the labels to the packages. For example, the conventional labeling systems use a single axis arm attached to a printer to apply the label to the box. The label is always applied to the same side of the box. The box is required to have a particular orientation relative to the printer and the label applicator. Known automated labeling systems do not tend to accommodate different sized packages.

A need remains for a dynamic, automated labeling system for labeling packages.

BRIEF DESCRIPTION OF THE INVENTION

In one embodiment, a robotic labeling system for labeling a package with a shipping label and at least one customer specified label is provided. The robotic labeling system includes a package locating system having a package positioner including a datum surface for locating the package at a labeling station. The robotic labeling system includes a package identification system having a scanning device configured to identify an orientation of the package in the labeling station. The robotic labeling system includes a label application system including a first label printer, a second label printer, a first label applicator, and a second label applicator. The first label printer is capable of printing the shipping label and the at least one customer specific label. The second label printer is capable of printing the shipping label and the at least one customer specific label. The first label applicator operates with the first label printer to apply a first label printed by the first label printer to the package being one of the shipping label or the at least one customer specific label. The second label applicator operates with the second label printer to apply a second label printed by the second label printer to the package being the other of the shipping label or the at least one customer specific label. The first label applicator applies the first label to a first side of the package. The second label applicator applies the second label to a second side of the package different than the first side. The printing of the first label and the second label is based on the orientation of the package in the labeling station. The application of the first label and the second label is based on the orientation of the package in the labeling station.

In another embodiment, a method of labeling a first package and a second package is provided. The method locates the first package in a labeling station and identifies an orientation of the first package in the labeling station using a scanning device. The method prints a first shipping label for the first package at a first label printer and applies the first shipping label using a first label applicator to a first side of the first package based on the orientation of the first package in the labeling station. The method prints a first customer specific label for the first package at a second label printer and applies the first customer specific label using a second label applicator to a second side of the first package based on the orientation of the first package in the labeling station. The method removes the first package from the labeling station, locates the second package in the labeling station and identifies an orientation of the second package in the labeling station using the scanning device. The method prints a second customer specific label for the second package at the first label printer and applies the second customer specific label using the first label applicator to a first side of the second package based on the orientation of the second package in the labeling station. The method prints a second shipping label for the second package at the second label printer and applies the second shipping label using the second label applicator to a second side of the second package based on the orientation of the second package in the labeling station.

DETAILED DESCRIPTION OF THE INVENTION

Figure 1:
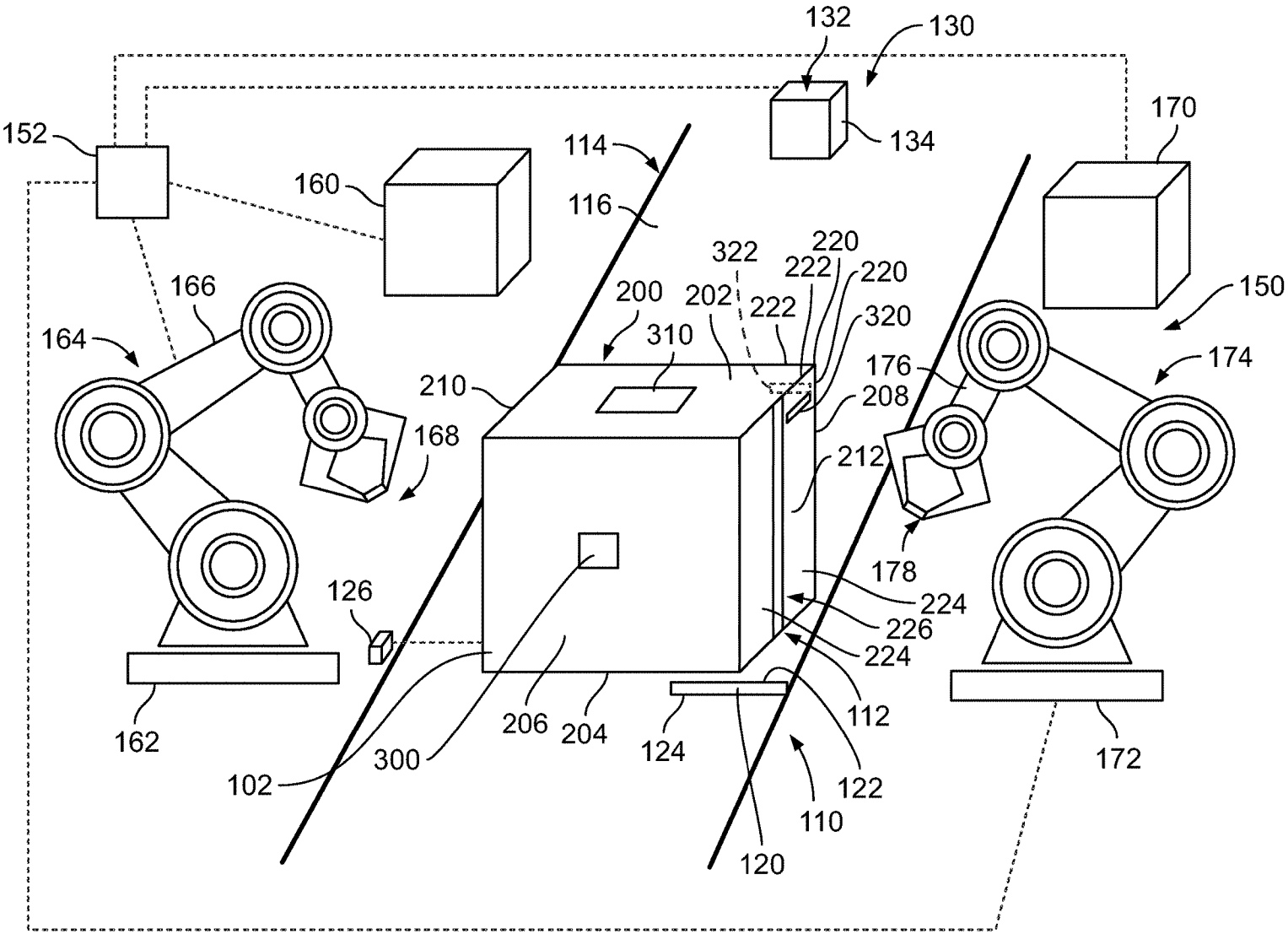
FIG. 1 illustrates a robotic labeling system in accordance with an exemplary embodiment showing a package in a front orientation having an identification tag at a front side of the package.

FIG. 1 illustrates a robotic labeling system 100 in accordance with an exemplary embodiment. The robotic labeling system 100 is an automated system used for labeling packages 102. In an exemplary embodiment, the robotic labeling system 100 utilizes multiple robots for applying two or more labels on a single package 102. The robotic labeling system 100 uses intelligent control algorithms operating within a framework having several constraints to assign tasks to the components of the robotic labeling system 100 for time efficient, dynamic labeling solutions.

The robotic labeling system 100 includes a package locating system 110 for locating the package 102 in a labeling station 112. The robotic labeling system 100 includes a package identification system 130 for identifying the package 102 in the labeling station 112. The robotic labeling system 100 includes a label application system 150 for applying labels to the package 102. In an exemplary embodiment, the label application system 150 applies multiple labels to each package 102. In an exemplary embodiment, the label application system 150 applies different types of labels to each package 102. The labels may be applied to various sides 200 of the package 102.

The package 102 may be a box, such as a cardboard box, or other type of container. In various embodiments, the package 102 may be parallelepiped having six sides 200, including a top side 202, a bottom side 204, a front side 206, a rear side 208, a right side 210, and a left side 212. The package 102 may include additional sides 200 in alternative embodiments. The package 102 may have other shapes in alternative embodiments. In various embodiments, the sides 200 may be flat or planar. Alternatively, one or more of the sides 200 may be curved. In an exemplary embodiment, the sides 200 meet at corners 220 and have edges 222 extending between the corners 220. In various embodiments, one or more the sides 200 may be defined by panels 224 meeting at seams 226. The panels 224 may be taped at the seams 226. In various embodiments, the label application system 150 may avoid applying the labels at the seams 226 (for example, avoid applying the labels over the tape).

In an exemplary embodiment, the package 102 includes an identification tag 300, also referred to as a license tag, at one of the sides 200. For example, the identification tag 300 may be a label applied to one of the sides 200. Alternatively, the identification tag 300 may be printed directly on one of the sides 200. The identification tag 300 is used to identify the particular package 102 (for example, compared to other packages 102). The identification tag 300 may be a unique identifier for the package 102. Information about the package 102 may be associated with the identification tag 300, such as data contained in a warehouse management system, and stored as identifying data. The identifying data about the package 102 may include content information relating to the contents of the package. The identifying data about the package 102 may include dimensional information relating to the height, width and length of the package. The identifying data may include shipping information relating to the package 102. In various embodiments, the identification tag 300 is a scannable tag, such as a barcode, a data matrix, a QR code, or another type of symbolic scan code. The identification tag 300 may be used to track the package 102 within a warehouse software system. In various embodiments, the identification tag 300 is applied to the package 102 outside of the labeling station 112. For example, the identification tag 300 may be applied to the package 102 prior to the package 102 being transported to the labeling station 112. The identification tag 300 may be applied to the package 102 when the package 102 is formed or when the package 102 is filled, such as at a packing station upstream of the labeling station 112. Alternatively, the identification tag 300 may be applied by the label application system 150 at the labeling station 112. The identification tag 300 may be applied to any of the sides 200. In various embodiments, the identification tag 300 may be on any of the sides 200 other than the bottom side 204. In various embodiments, multiple identification tags 300 may be provided, such as on two opposite sides (for example, to avoid having the identification tag 300 on the bottom side 204, and thus unviewable, as the package 102 is presented to the labeling station 112).

In an exemplary embodiment, the package 102 receives a shipping label 310. The shipping label 310 contains information about where the package 102 is being shipped. The shipping label 310 may include a name, an address, or other identifying data. In various embodiments, the shipping label 310 may include symbolic scan codes used for shipping. The shipping label 310 is applied to the package 102 by the label application system 150 at the labeling station 112. The shipping label 310 may be applied to any of the sides 200 other than the bottom side 204. In an exemplary embodiment, the shipping label 310 is applied to any of the sides 200 that does not include the identification tag 300. In various embodiments, the label application system 150 does not apply any other labels to the side 200 that receives the shipping label 310.

In an exemplary embodiment, the package 102 receives one or more customer specified labels, such as a first customer specified label 320 and a second customer specified label 322. The customer specified label 322 may contain information about the contents of the package 102 or other information. For example, the customer specified label 322 may contain information about the shipper of the package 102, the location of where the package 102 is being shipped from, return shipping information, warning labels regarding the package 102 or the content of the package 102, and the like. In various embodiments, the first and second customer specified labels 320, 322 are identical. In alternative embodiments, the package 102 may receive customer specified labels 320, 322 containing different information. In various embodiments, the customer specified labels 320, 322 may include symbolic scan codes having data relating to the content of the package 102 or other information. The customer specified labels 320, 322 are applied to the package 102 by the label application system 150 at the labeling station 112. The customer specified labels 320, 322 may be applied to any of the sides 200 other than the bottom side 204. In an exemplary embodiment, the customer specified labels 320, 322 are applied to different sides 200. Optionally, the customer specified labels 320, 322 may be applied to adjacent sides and may be located proximate to each other, such as proximate to one of the edges 222 and/or proximate to one of the corners 220. The customer specified labels 320, 322 are applied to any of the sides 200 that do not include the identification tag 300. In various embodiments, the label application system 150 does not apply any other labels to the sides 200 that receive the customer specified labels 320, 322. For example, the shipping label 310 is applied to a different side 200 than the customer specified labels 320, 322. Other types of labels may be applied to the package 102 in alternative embodiments.

In an exemplary embodiment, the package locating system 110 includes a transportation device 114 for moving the package 102 to the labeling station 112. In the illustrated embodiment, the transportation device 114 includes a conveyor 116. Other types of transportation devices 114 may be used in alternative embodiments. The package locating system 110 includes a package positioner 120 having one or more datum surfaces 122 for locating the package 102 in the labeling station 112. In the illustrated embodiment, the package positioner 120 includes a stop gate 124 used to stop the package 102 on the conveyor 116. In various embodiments, the package locating system 110 may include a trigger 126 used to stop the conveyor 116 when the package 102 engages the stop gate 124. The stop gate 124 has a rear facing surface defining the datum surface 122. When the package 102 engages the stop gate 124, the location of the package 102 is known by the robotic labeling system 100 for applying the labels to the package 102. The stop gate 124 locates the package 102 in a first direction, such as a front-to-rear. Optionally, the stop gate 124 may include additional datum surfaces 122 to locate the package 102 in a second direction, such as side-to-side. Alternatively, a second stop gate 124 may be provided to locate the package 102 in the second direction. Other types of package positioning devices may be used in alternative embodiments.

In an exemplary embodiment, the package identification system 130 includes a scanning device 132 for identifying the package 102. The scanning device 132 may be located upstream of the labeling station 112 in various embodiments, such as along the conveyor upstream of the package positioner 120. The scanning device 132 may be located at the labeling station 112 in various embodiments to scan the package 102 when the package 102 is at the package positioner 120. In various embodiments, the scanning device 132 may include one or more cameras 134 for scanning the package 102. The cameras 134 may image the package 102 and create a digital image of the package 102. In various embodiments, the scanning device 132 may be a reader configured to read a scannable code on the package 102, such as on the identification tag 300 of the package. In an exemplary embodiment, the camera(s) 134 are configured to view multiple sides 200 of the package 102. The scanning device 132 identifies an orientation of the package 102 in the labeling station 112. The label application system 150 is controlled based on the orientation of the package 102. The orientation of the package 102 in the labeling station 112 may be based on the sides 200 having the identification tag 300. The scanning device 132 identifies the particular side 200 having the identification tag 300. For example, the scanning device 132 may identify the top side 202 as having the identification tag 300 (top-side orientation); may identify the front side 206 is having the identification tag 300 (front-side orientation); may identify the rear side 208 as having the identification tag 300 (rear-side orientation); may identify the right side 210 as having the identification tag 300 (right-side orientation); or may identify the left side 212 as having the identification tag 300 (left-side orientation). The operation of the label application system 150 is controlled based on which side 200 has the identification tag 300. For example, the label application system 150 may determine appropriate sides 200 to apply the shipping label 310 and the customer specified labels 320, 322 based upon which side 200 has the identification tag 300.

In an exemplary embodiment, the package identification system 130 identifies a size of the package 102 and a shape of the package 102. For example, the scanning device 132 may identify the number of sides 200, the number of corners, the number of edges, the number of seams 226, the location of the seams 226, and the like. The scanning device 132 may identify a height of the package 102 and/or a width of the package 102 and/or a length of the package 102. The size dimensions of the package 102 are used to control the label application system 150. For example, the label application system 150 may use the size dimensions and the datum surfaces 122 to determine relevant labeling locations on the package 102. In an exemplary embodiment, the robotic labeling system 100 is capable of receiving different sized and shaped packages 102 and is capable of labeling such packages 102 by automatically determining the size and shape of the particular package 102 at the labeling station 112. In various embodiments, the scanning device 132 may be used to scan the identification tag 300 and determine the size and shape of the package 102 based on data from the identification tag 300.

The label application system 150 is used to apply multiple labels to different sides 200 of the package 102. In an exemplary embodiment, the label application system 150 includes a first label printer 160 and a second label printer 170 configured to print corresponding labels for the package 102. The label application system 150 includes a first label applicator 162 and a second label applicator 172 configured to transfer the labels from the first and second label printers 160, 170, respectively, to the package 102. The first and second label applicators 162, 172 are used to apply the corresponding labels to the package 102. For example, the first and second label applicators 162, 172 may press the labels onto the sides 200 of the package 102.

The first label applicator 162 is a right-side label applicator located at a right side of the labeling station 112. The first label applicator 162 works in association with the first label printer 160 and retrieves labels from the first label printer 160 rather than the second label printer 170, such as to avoid interference or crashing of the label applicators 162, 172 during operation. For example, the first label printer 160 may be located at the right side of the labeling station 112 for easy access by the first label applicator 162 to retrieve the labels. In various embodiments, the first label printer 160 may be located rearward of the first label applicator 162. Other locations are possible in alternative embodiments. For example, the first label printer 160 may be located above the first label applicator 162 or may be located outside of the first label applicator 162 (for example, the first label applicator 162 may be located between the first label printer 160 and the package 102).

In an exemplary embodiment, the first label applicator 162 includes a first multi-axis robot 164 having an articulating arm 166 that moves between the first label printer 160 and the package 102. A first end effector 168 is provided at the end of the arm 166 to pick up the label from the first label printer 160 and to apply the label to the side 200 of the package 102. The first label applicator 162 (being at the right side) is capable of applying labels to the right side 210, the top side 202, the front side 206 and the rear side 208 of the package 102, but not the left side 212 of the package 102 or the bottom side 204. Rather, the second label applicator 172 is used to apply labels to the left side 212.

The second label applicator 172 is a left-side label applicator located at a left side of the labeling station 112. The second label applicator 172 works in association with the second label printer 170 and retrieves labels from the second label printer 170 rather than the first label printer 160, such as to avoid interference or crashing of the label applicators 162, 172 during operation. The second label printer 170 may be located at the right side of the labeling station 112 for easy access by the second label applicator 172 to retrieve the labels. In various embodiments, the second label printer 170 may be located rearward of the second label applicator 172. Other locations are possible in alternative embodiments. For example, the second label printer 170 may be located above the second label applicator 172 or may be located outside of the second label applicator 172 (for example, the second label applicator 172 may be located between the second label printer 170 and the package 102).

In an exemplary embodiment, the second label applicator 172 includes a second multi-axis robot 174 having an articulating arm 176 that moves between the second label printer 170 and the package 102. A second end effector 178 is provided at the end of the arm 176 to pickup the label from the second label printer 170 and to apply the label to the side 200 of the package 102. In various embodiments, the end effectors 168, 178 may be vacuum end defectors configured to hold the labels. Other types of end effectors may be used in alternative embodiments. The second label applicator 172 (being at the left side) is capable of applying labels to the left side 212, the top side 202, the front side 206 and the rear side 208 of the package 102, but not the right side 210 of the package 102 or the bottom side 204. Rather, the first label applicator 162 is used to apply labels to the right side 210.

In an exemplary embodiment, the first label printer 160 is capable of printing both the shipping label 310 and the customer specified labels 320, 322. Similarly, the second label printer 170 is capable of printing both the shipping label 310 and the customer specified labels 320, 322. The operation of the first and second label printers 160, 170 may be controlled based on the orientation of the package 102. For example, the operation of the first and second label printers 160, 170 may be controlled based on the location of the identification tag 300. In a first labeling scheme, the first label printer 160 prints the shipping label 310 and the second label printer 170 prints the customer specified labels 320, 322. In a second labeling scheme, the first label printer 160 prints the customer specified labels 320, 322 and the second label printer 170 prints the shipping label 310.

In an alternative embodiment, the label application system 150 may include a third label printer and a third label applicator (not shown) capable of printing different labels than the first and second label printers 160, 170 and applying such labels to an appropriate side 200 of the package 102. Other types of label applicators, other than multi-axis robot, may be used in alternative embodiments.

In an exemplary embodiment, the label application system 150 includes a controller 152 that controls operation of the label application system 150. The controller 152 is operably coupled to the first and second label printers 160, 170 and the first and second label applicators 162, 172. The controller 152 receives inputs from the package locating system 110 and the package identification system 130 to determine a labeling scheme for labeling the package 102. The controller 152 determines which of the label printers 160, 170 is used to print the shipping label 310 and which of the label printers 160, 170 is used to print the customer specified labels 320, 322. The controller 152 determines which of the label applicators 162 is used to apply the shipping label 310 and which of the label applicators 162, 172 is used to apply the customer specified labels 320, 322. The controller 152 controls operation of the label printers 160, 170 and the label applicators 162, 172 based on the orientation of the package 102. For example, the controller 152 controls operation of the label printers 160, 170 and the label applicators 162, 172 based on the sides 200 having the identification tag 300. The controller 152 controls operation of the label applicators 162, 172 based on the size and shape of the package 102 determined by the package identification system 130. For example, the controller 152 determines appropriate labeling locations relative to the datum surface 122, based on the size and shape of the package 102, and controls movements of the label applicators 162, 172 to move to such labeling locations.

FIG. 1 illustrates the package 102 in a front orientation having the identification tag 300 at the front side 206. FIG. 1 illustrates an exemplary labeling scheme for the front orientation package showing the shipping label 310 and the customer specified labels 320, 322 in exemplary locations. The shipping label 310 and the customer specified labels 320, 322 are on different sides 200 of the package 102 from each other and from the identification tag 300. In the illustrated embodiment, the shipping label 310 is applied to the top side 202, the first customer specified label 320 is applied to the left side 212 and the second customer specified label 322 (shown in phantom) is applied to the rear side 208. The right side 210 does not include any label in the labeling scheme illustrated in FIG. 1. In alternative embodiments, a fifth label (not shown) may be applied to the unlabeled fifth side (right side 210), if another label is needed. In an exemplary embodiment, the second label applicator 172 is used to apply the first and second customer specified labels 320, 322 and the first label applicator 162 is used to apply the shipping label 310.

Figure 2:
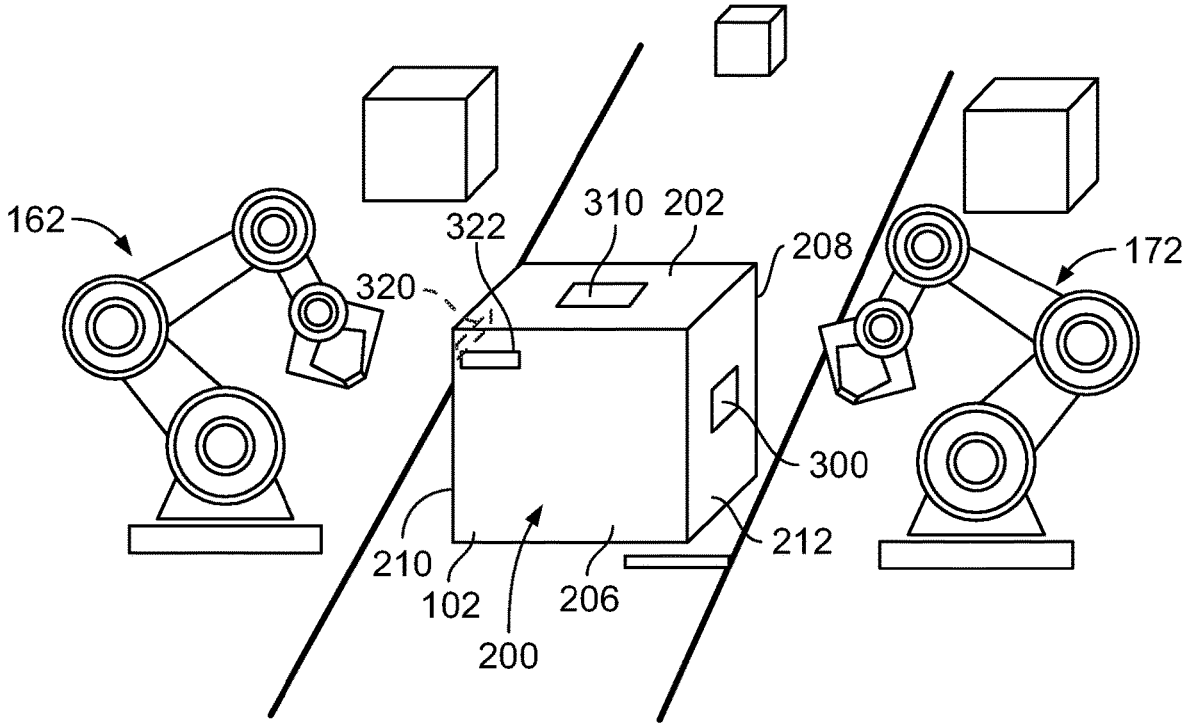
FIG. 2 illustrates the robotic labeling system showing the package in a left orientation having the identification tag at the left side in accordance with an exemplary embodiment.

FIG. 2 illustrates the package 102 in a left orientation having the identification tag 300 at the left side 212. FIG. 2 illustrates an exemplary labeling scheme for the rear orientation package showing the shipping label 310 and the customer specified labels 320, 322 in exemplary locations. The shipping label 310 and the customer specified labels 320, 322 are on different sides 200 of the package 102 from each other and from the identification tag 300. In the illustrated embodiment, the shipping label 310 is applied to the top side 202, the first customer specified label 320 is applied to the right side 208 and the second customer specified label 322 is applied to the front side 206. The rear side 208 does not include any label in the labeling scheme illustrated in FIG. 2. In alternative embodiments, a fifth label (not shown) may be applied to the unlabeled fifth side (rear side 208), if another label is needed. In an exemplary embodiment, the first label applicator 162 is used to apply the first and second customer specified labels 320, 322 and the second label applicator 172 is used to apply the shipping label 310.

Figure 3:
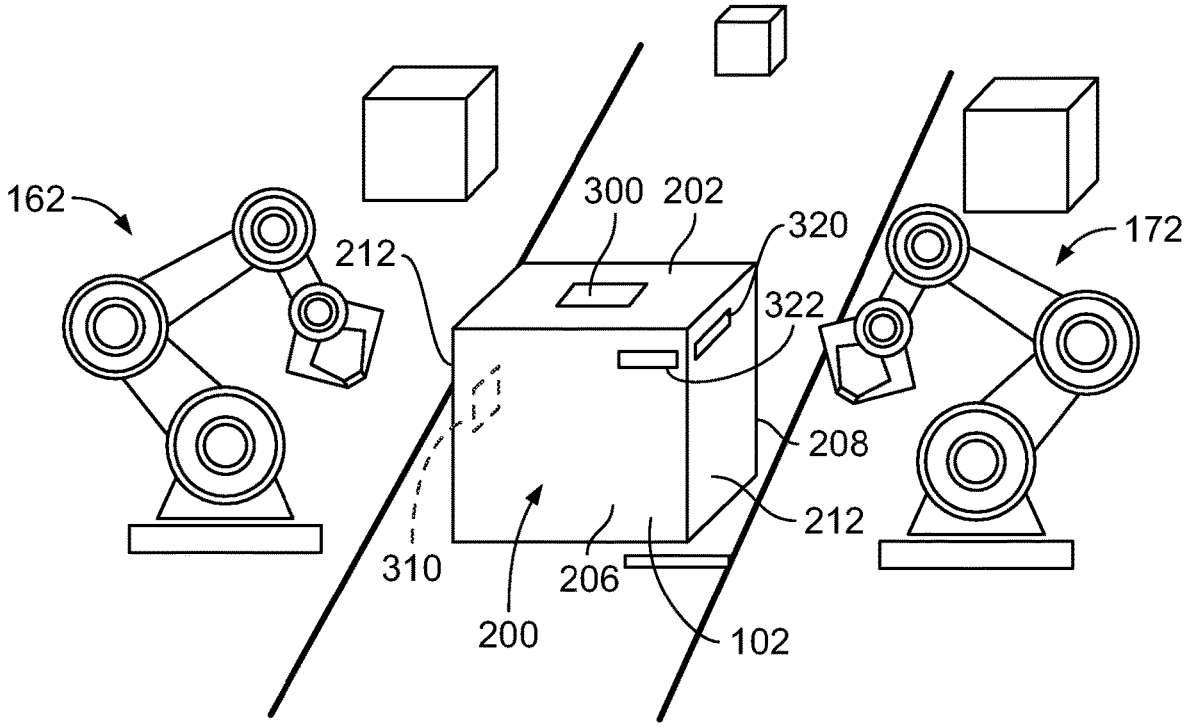
FIG. 3 illustrates the robotic labeling system showing the package in a top orientation having the identification tag at the top side in accordance with an exemplary embodiment.

FIG. 3 illustrates the package 102 in a top orientation having the identification tag 300 at the top side 202. FIG. 3 illustrates an exemplary labeling scheme for the top orientation package showing the shipping label 310 and the customer specified labels 320, 322 in exemplary locations. The shipping label 310 and the customer specified labels 320, 322 are on different sides 200 of the package 102 from each other and from the identification tag 300. In the illustrated embodiment, the shipping label 310 is applied to the right side 210, the first customer specified label 320 is applied to the left side 212 and the second customer specified label 322 is applied to the front side 206. The rear side 208 does not include any label in the labeling scheme illustrated in FIG. 1. In alternative embodiments, a fifth label (not shown) may be applied to the unlabeled fifth side (rear side 208), if another label is needed. In an exemplary embodiment, the second label applicator 172 is used to apply the first and second customer specified labels 320, 322 and the first label applicator 162 is used to apply the shipping label 310.

Figure 4:
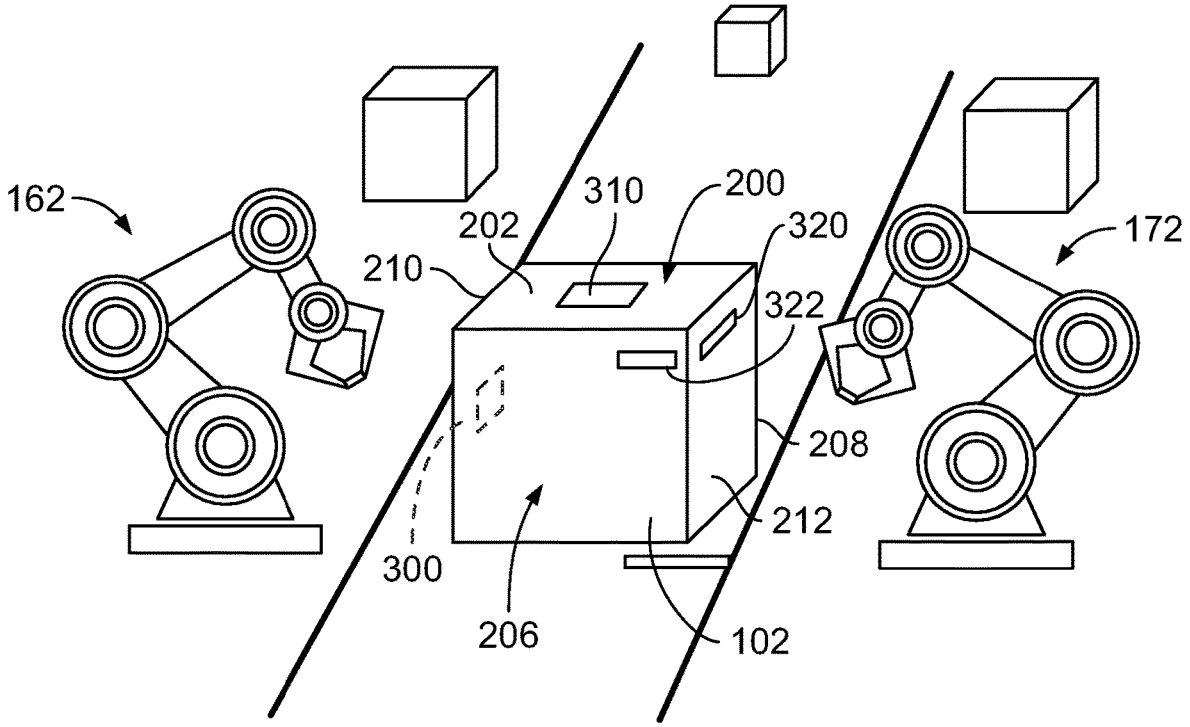
FIG. 4 illustrates the robotic labeling system showing the package in a right orientation having the identification tag at the right side in accordance with an exemplary embodiment.

FIG. 4 illustrates the package 102 in a right orientation having the identification tag 300 at the right side 210. FIG. 1 illustrates an exemplary labeling scheme for the right orientation package showing the shipping label 310 and the customer specified labels 320, 322 in exemplary locations. The shipping label 310 and the customer specified labels 320, 322 are on different sides 200 of the package 102 from each other and from the identification tag 300. In the illustrated embodiment, the shipping label 310 is applied to the top side 202, the first customer specified label 320 is applied to the left side 212 and the second customer specified label 322 is applied to the front side 206. The rear side 208 does not include any label in the labeling scheme illustrated in FIG. 4. In alternative embodiments, a fifth label (not shown) may be applied to the unlabeled fifth side (rear side 208), if another label is needed. In an exemplary embodiment, the second label applicator 172 is used to apply the first and second customer specified labels 320, 322 and the first label applicator 162 is used to apply the shipping label 310.

Figure 5:
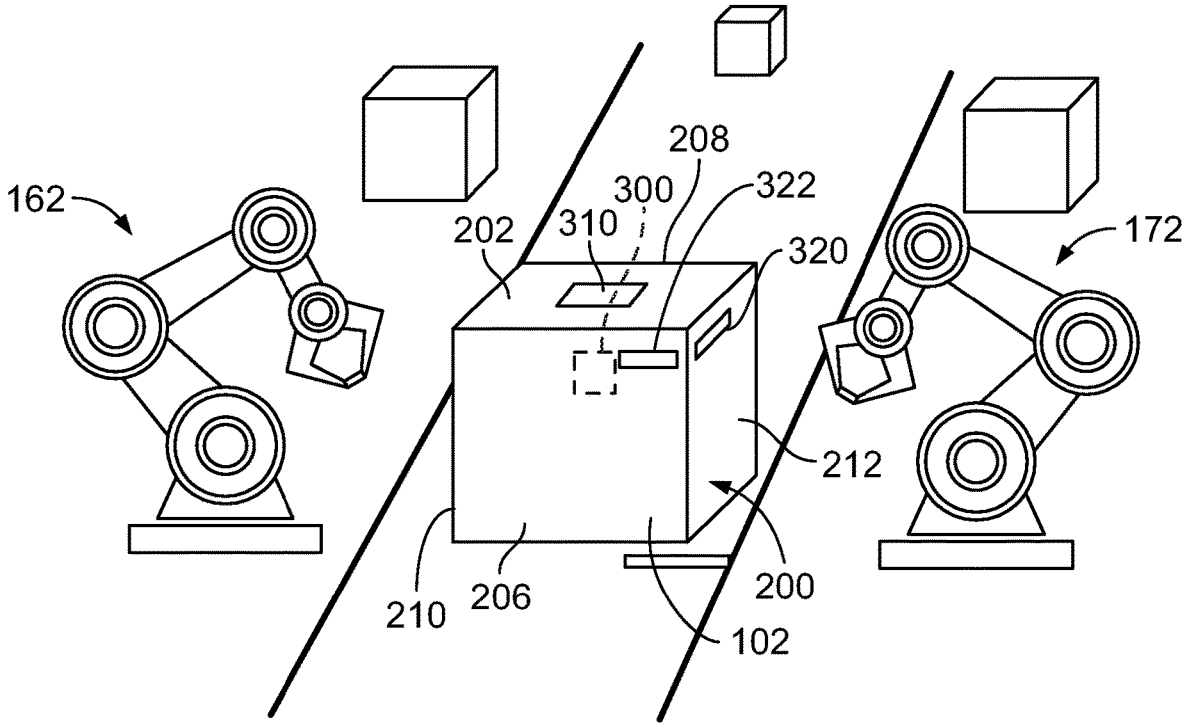
FIG. 5 illustrates the robotic labeling system showing the package in a rear orientation having the identification tag at the rear side in accordance with an exemplary embodiment.

FIG. 5 illustrates the package 102 in a rear orientation having the identification tag 300 (shown in phantom) at the rear side 208. FIG. 5 illustrates an exemplary labeling scheme for the rear orientation package showing the shipping label 310 and the customer specified labels 320, 322 in exemplary locations. The shipping label 310 and the customer specified labels 320, 322 are on different sides 200 of the package 102 from each other and from the identification tag 300. In the illustrated embodiment, the shipping label 310 is applied to the top side 202, the first customer specified label 320 is applied to the left side 212 and the second customer specified label 322 is applied to the front side 206. The front side 206 does not include any label in the labeling scheme illustrated in FIG. 5. In alternative embodiments, a fifth label (not shown) may be applied to the unlabeled fifth side (front side 206), if another label is needed. In an exemplary embodiment, the second label applicator 172 is used to apply the first and second customer specified labels 320, 322 and the first label applicator 162 is used to apply the shipping label 310.

Figure 6:
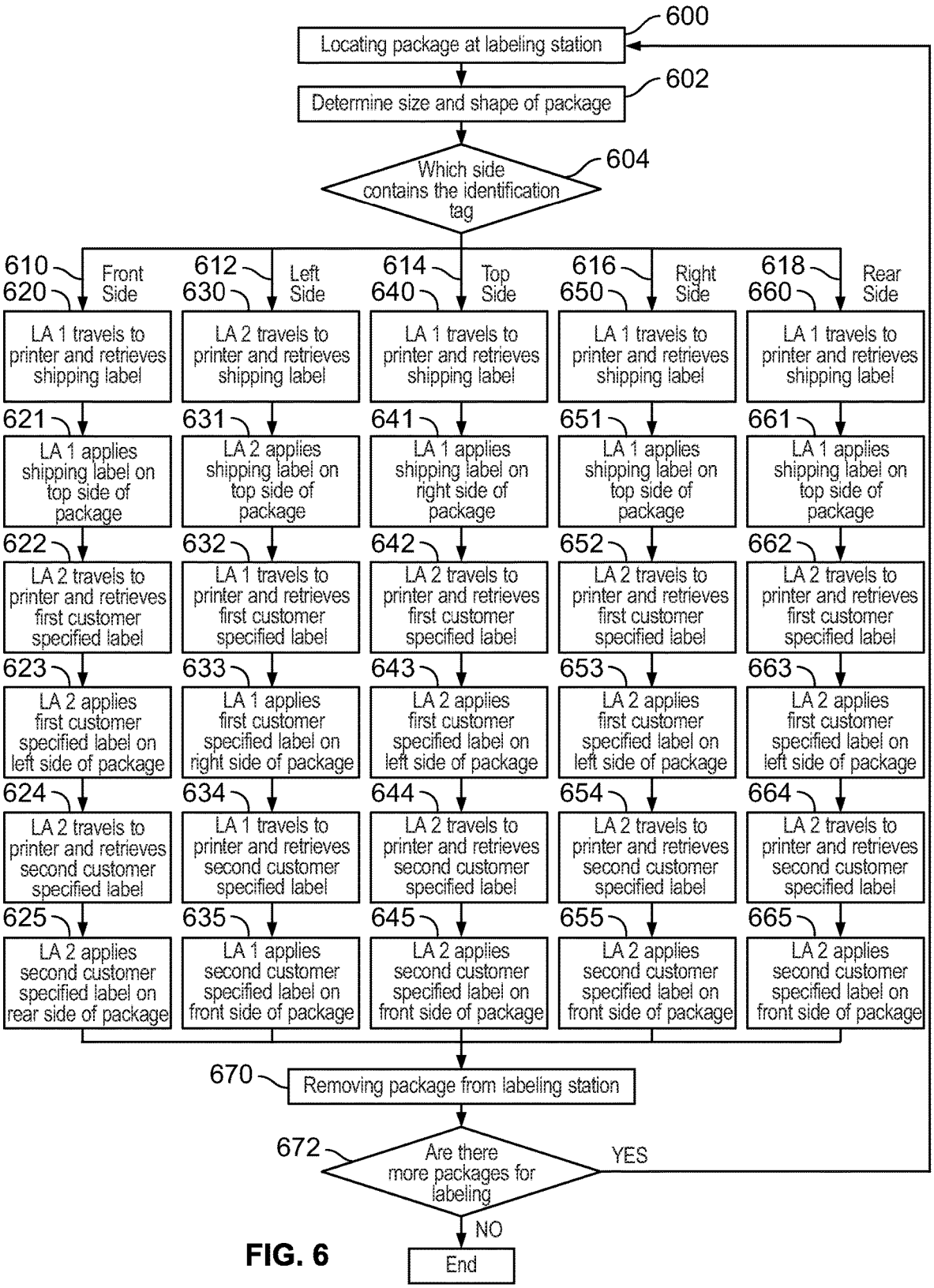
FIG. 6 is a flowchart showing a method of labeling packages in accordance with an exemplary embodiment.

FIG. 6 is a flowchart showing a method of labeling packages in accordance with an exemplary embodiment. The method may be used by a controller of a label application system (such as the controller 152 shown in FIG. 1) to determine an appropriate labeling scheme for the particular package. The controller includes logic configured to determine an appropriate labeling scheme based on the package orientation. The labeling scheme is based on the size of the package, the shape of the package, the number of labels that need to be applied to the package, relative locations of the labels (for example, same sides, different sides, adjacent sides, opposite sides, and the like). The labeling scheme developed using the method may be based on which side of the package has the identification tag as presented in the labeling station.

The method includes locating 600 the package at a labeling station. For example, the package may be transported to the labeling station by a conveyor or other transportation device. The package may be located by a package positioner, such as a stop gate having a datum surface. By locating the package at a particular location (for example, at the datum surface), the labels may be accurately applied.

In various embodiments, the method optionally includes the step of determining 602 a size and a shape of the package. The size and shape of the package may be determined automatically, such as using a camera or other type of scanning device. For example, the package may be imaged at the labeling station or as the package is moving to the labeling station. The labeling system may identify the number of sides, the number of corners, the number of edges, the number of panels and seems between the panels, the dimensions of the sides (for example, height and/or width and/or length of the sides), and the like. In other various embodiments, the package labeling system may scan the identification tag to determine the size and shape of the package. The size and shape of the package is determined for proper label application. For example, the various sides are located relative to the datum surface and thus the label application robot may be controlled to label the package based on the size and shape of the package. The controller is configured to determine the size based on inputs from the scanning device. As such, the labeling scheme may be controlled automatically without user input based on signals or inputs from the scanning device.

The method includes identifying 604 an orientation of the package in the labeling station. The orientation may be determined automatically, such as using a camera or other type of scanning device. For example, the package may be imaged at the labeling station or as the package is moving to the labeling station. In an exemplary embodiment, the orientation of the package may be identified by determining which side of the package contains the identification tag. For example, the front side, the left side, the top side, the right side, or the rear side may be identified as having the identification tag. Application of other labels is controlled based on the orientation of the package in the labeling station. For example, the other labels may be applied to other sides based on which side of the package having the identification tag. The controller is configured to determine the orientation based on inputs from the scanning device. As such, the labeling scheme may be controlled automatically without user input based on signals or inputs from the scanning device.

The labeling process is performed differently based on which side of the package contains the identification tag. The flow path for the labeling process may be based on the side of the package that contains the identification tag. For example, if the identification tag is provided at the front side, the process follows flow path 610. If the identification tag is provided at the left side, the process follows flow path 612. If the identification tag is provided at the top side, the process follows flow path 614. If the identification tag is provided at the right side, the process follows flow path 616. If the identification tag is provided at the rear side, the process follows flow path 618. The controller controls the label application system accordingly to the various labeling schemes defined by the flow paths 610-618 based on the orientation of the particular package. As such, the package labeling may be performed efficiently no matter what orientation the package is presented to the labeling station. The packages may thus be delivered to the labeling station without the need for manual positioning of the packages.

In an exemplary embodiment, the robotic labeling system 100 includes multiple label applicators or "LA" as shown in FIG. 6, for applying different types of labels to the package. In various embodiments, the robotic labeling system includes two label applicators ("LA 1" and "LA 2") arranged on opposite sides of the labeling station for applying the labels to the package. The robotic labeling system 100 may operate under a number of constraints to dynamically determine an efficient labeling scheme for the particular package at the labeling station. The labeling scheme may be different for different packages presented at the labeling station.

In various embodiments, the robotic labeling system may be operated in such a manner that the first label applicator can only accept labels from the corresponding first label printer and the second label applicator can only accept labels from the corresponding second label printer. Such a constraint avoids collusion between the label applicators by restricting the first label applicator from moving to an area proximate to the second label printer and restricting the second label applicator from moving to an area proximate to the first label printer.

In various embodiments, the robotic labeling system may be operated in such a manner that the first label printer prints different labels than the second label printer. For example, one of the label printers may print a shipping label and the other label printer may ship customer specified labels. Optionally, multiple customer specified labels may be printed and applied to each package. The customer specified labels may be identical. Alternatively, the customer specified labels may be different from each other. In various embodiments, both label printers are capable of printing either type of labels.

In various embodiments, the robotic labeling system may be operated in such a manner that the printed labels cannot be placed on the side of the package on which the identification tag is present. In various embodiments, the robotic labeling system may be operated in such a manner that none of the printed labels are placed on the same side of the package as each other. For example, each printed label must be placed on a different side of the package.

In various embodiments, the robotic labeling system may be operated in such a manner that two customer specified labels are to be printed and applied to the package. The customer specified labels are to be positioned on adjoining sides. The customer specified labels are to be positioned proximate to the edge between the adjoining sides. The customer specified labels are to be positioned proximate to a corner of the package. In various embodiments, the robotic labeling system may be operated in such a manner that the two customer specified labels are restricted from application to the top side or the bottom side of the package. The two customer specified labels must be provided on two adjoining sides of the front side, the rear side, the right side and the left side.

In various embodiments, the robotic labeling system may be operated in a first labeling scheme, wherein the first label printer prints the two customer specified labels and the second label printer prints one shipping label for the package; and the robotic labeling system may be operated in a second labeling scheme, wherein the first label printer prints one shipping label and the second label printer prints the two customer specified labels for the package. However, other labeling schemes are possible in alternative embodiments, such as where a second shipping label is printed or where another customer specified labels printed such that each printer prints the same number of labels.

In various embodiments, the robotic labeling system may be operated in such a manner that the first label applicator (being at the right side) is capable of applying labels to the right side, the top side, the front side and the rear side of the package, but not the left side of the package or the bottom side. The robotic labeling system may be operated in such a manner that the second label applicator (being at the left side) is capable of applying labels to the left side, the top side, the front side and the rear side of the package, but not the right side of the package or the bottom side.

The robotic labeling system includes a controller for controlling the operations of the label printers and the label applicators. The controller uses a control process, such as the method shown in FIG. 6, to determine an efficient label application solution to apply the labels to the package following one or more of the labeling constraints identified by the operator of the robotic labeling system. The label application solution is based on the orientation of the package at the labeling station. The method shown in FIG. 6 satisfies each of the constraints identified above to apply the one shipping label and the two customer specified labels to the package using the first and second label applicators in the first and second label printers.

In the front orientation (610) having the identification tag at the front side of the package, the first label applicator is used to apply the shipping label and the second label applicator is used to apply the two customer specified labels. At 620, the first label applicator travels to the first label printer and retrieves the shipping label from the first label printer. The controller may trigger the first label printer to print the shipping label when the first label applicator is at the first label printer or may trigger the first label printer to print the shipping label prior to the first label applicator arriving at the first label printer. At 621, the first label applicator travels, with the shipping label, to the top side of the package and applies the shipping label to the top side of the package.

At 622, the second label applicator travels to the second label printer and retrieves the first customer specified label from the second label printer. The controller may trigger the second label printer to print the first customer specified label when the second label applicator is at the second label printer or may trigger the second label printer to print the first customer specified label prior to the second label applicator arriving at the second label printer. At 623, the second label applicator travels, with the first customer specified label, to the left side of the package and applies the first customer specified label to the left side of the package.

At 624, the second label applicator travels to the second label printer and retrieves the second customer specified label from the second label printer. The controller may trigger the second label printer to print the second customer specified label when the second label applicator is at the second label printer or may trigger the second label printer to print the second customer specified label prior to the second label applicator arriving at the second label printer. At 625, the second label applicator travels, with the second customer specified label, to the rear side of the package and applies the second customer specified label to the rear side of the package.

When the labeling process is complete, the method includes removing 670 the package from the labeling station. For example, the stop gate may be moved to allow the package to be removed. In various embodiments, the conveyor may move the package to a different station, such as a package sorting station after the labels have been applied to the package. The method further includes determining 672 if additional packages need labeling. If there are no additional packages, the system may be shut down. If additional packages need labeling, the method returns to step 600 to locate another package at the labeling station.

In the left orientation (612) having the identification tag at the left side of the package, the second label applicator is used to apply the shipping label and the first label applicator is used to apply the two customer specified labels. At 630, the second label applicator travels to the second label printer and retrieves the shipping label from the second label printer. At 631, the second label applicator travels, with the shipping label, to the top side of the package and applies the shipping label to the top side of the package. At 632, the first label applicator travels to the first label printer and retrieves the first customer specified label from the first label printer. At 633, the first label applicator travels, with the first customer specified label, to the right side of the package and applies the first customer specified label to the right side of the package. At 634, the first label applicator travels to the first label printer and retrieves the second customer specified label from the first label printer. At 635, the first label applicator travels, with the second customer specified label, to the front side of the package and applies the second customer specified label to the front side of the package. When the labeling process is complete, the method includes removing 670 the package from the labeling station and determining 672 if additional packages need labeling.

In the top orientation (614) having the identification tag at the top side of the package, the first label applicator is used to apply the shipping label and the second label applicator is used to apply the two customer specified labels. At 640, the first label applicator travels to the first label printer and retrieves the shipping label from the first label printer. At 641, the first label applicator travels, with the shipping label, to the right side of the package and applies the shipping label to the right side of the package. At 642, the second label applicator travels to the second label printer and retrieves the first customer specified label from the second label printer. At 643, the second label applicator travels, with the first customer specified label, to the left side of the package and applies the first customer specified label to the left side of the package. At 644, the second label applicator travels to the second label printer and retrieves the second customer specified label from the second label printer. At 645, the second label applicator travels, with the second customer specified label, to the front side of the package and applies the second customer specified label to the front side of the package. When the labeling process is complete, the method includes removing 670 the package from the labeling station and determining 672 if additional packages need labeling.

In the right orientation (616) having the identification tag at the right side of the package, the first label applicator is used to apply the shipping label and the second label applicator is used to apply the two customer specified labels. At 650, the first label applicator travels to the first label printer and retrieves the shipping label from the first label printer. At 651, the first label applicator travels, with the shipping label, to the top side of the package and applies the shipping label to the top side of the package. At 652, the second label applicator travels to the second label printer and retrieves the first customer specified label from the second label printer. At 653, the second label applicator travels, with the first customer specified label, to the left side of the package and applies the first customer specified label to the left side of the package. At 654, the second label applicator travels to the second label printer and retrieves the second customer specified label from the second label printer. At 655, the second label applicator travels, with the second customer specified label, to the front side of the package and applies the second customer specified label to the front side of the package. When the labeling process is complete, the method includes removing 670 the package from the labeling station and determining 672 if additional packages need labeling.

In the rear orientation (618) having the identification tag at the rear side of the package, the first label applicator is used to apply the shipping label and the second label applicator is used to apply the two customer specified labels. At 660, the first label applicator travels to the first label printer and retrieves the shipping label from the first label printer. At 661, the first label applicator travels, with the shipping label, to the top side of the package and applies the shipping label to the top side of the package. At 662, the second label applicator travels to the second label printer and retrieves the first customer specified label from the second label printer. At 663, the second label applicator travels, with the first customer specified label, to the left side of the package and applies the first customer specified label to the left side of the package. At 664, the second label applicator travels to the second label printer and retrieves the second customer specified label from the second label printer. At 665, the second label applicator travels, with the second customer specified label, to the front side of the package and applies the second customer specified label to the front side of the package. When the labeling process is complete, the method includes removing 670 the package from the labeling station and determining 672 if additional packages need labeling.

The method shown in FIG. 6 identifies merely an exemplary embodiment and labeling schemes for applying the labels to the various sides of the package based on the orientation of the package in the labeling station. The first and second label applicators may apply the various labels to other sides in alternative embodiments while still avoiding application of any labels to the side having the identification tag. For example, each package presented to the labeling station has five sides that could potentially receive labels (the bottom side is inaccessible), only one of which has the identification tag. In the embodiment illustrated in FIG. 6, the robotic labeling system is used to apply three labels (one shipping label and two customer specified labels) to four open sides. The controller could be programmed to apply one of the labels, such as the shipping label, to the open sides rather than the side identified in the particular example labeling schemes shown in FIG. 6 without affecting application of the customer specified labels. Additionally, the controller could be programmed to switch the sides that the first and second customer specified labels are applied to without affecting application of the shipping label. Additionally, the controller could be programmed to apply one of the customer specified labels to the open sides rather than the side identified in the particular example labeling schemes shown in FIG. 6 without affecting application of the shipping label.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A robotic labeling system for labeling a package with a shipping label and at least one customer specified label, the robotic labeling system comprising:

a package locating system having a package positioner including a datum surface for locating the package at a labeling station;

a package identification system having a scanning device configured to identify an orientation of the package in the labeling station, the scanning device imaging an identification tag on the package to identify the orientation of the package by determining a side of the package on which the identification tag is located; and a label application system including a first label printer, a second label printer, a first label applicator, and a second label applicator, the first label printer capable of printing the shipping label and the at least one customer specific label, the second label printer capable of printing the shipping label and the at least one customer specific label, the first label applicator operating with the first label printer to apply a first label printed by the first label printer to the package being one of the shipping label or the at least one customer specific label, the second label applicator operating with the second label printer to apply a second label printed by the second label printer to the package being the other of the shipping label or the at least one customer specific label, the first label applicator applying the first label to a first side of the package, the second label applicator applying the second label to a second side of the package different than the first side, wherein the printing of the first label and the second label is based on the orientation of the package in the labeling station and wherein the application of the first label and the second label is based on the orientation of the package in the labeling station.

2. The robotic labeling system of claim 1, wherein at least one of the first label printer or the second label printer printing a third label being one of the at least one customer specified labels, the corresponding first label applicator or the second label applicator operating to apply the third label to a third side of the package different than the first side and the second side.

3. The robotic labeling system of claim 2, wherein the second side and the third side of the package meet at a corner, the first label applicator and the second label applicator applying the second label and the third label adjacent the corner.

4. The robotic labeling system of claim 1, wherein the scanning device images multiple sides of the package to determine which of the sides of the package that includes the identification tag to identify the orientation of the package.

5. The robotic labeling system of claim 4, wherein the identification tag is on a third side of the package different than the first side and the second side.

6. The robotic labeling system of claim 1, wherein the scanning device images the package to determine a size and a shape of the package, the first label applicator and the second label applicator operating based on the determined size and the determined shape of the package.

7. The robotic labeling system of claim 1, wherein the package positioner includes a stop gate engaging at least one side of the package to locate the package in the labeling station.

8. The robotic labeling system of claim 1, wherein the package locating system further comprises a conveyor moving the package to the package positioner.

9. The robotic labeling system of claim 1, wherein the first label applicator includes a multi-axis robot having an end effector configured to transport the labels from the first label printer to the package and wherein the second label applicator includes a multi-axis robot having an end effector configured to transport the labels from the second label printer to the package.

10. The robotic labeling system of claim 1, wherein the first label applicator is a right side label applicator positioned at a right side of the labeling station and the second label applicator is a left side label applicator positioned at a left side of the labeling station, the right side label applicator being capable of applying labels to a right side, a front side, a rear side, and a top side of the package but not a left side of the package, the left side label applicator being capable of applying labels to the left side, the front side, the rear side, and the top side of the package but not the right side of the package.

11. The robotic labeling system of claim 1, wherein the second label applicator applies the second label based on the location on the package that the first label applicator applies the first label.

12. A method of labeling a first package and a second package comprising:

locating the first package in a labeling station;

identifying an orientation of the first package in the labeling station using a scanning device by determining a side of the first package on which a first identification tag is located;

printing a first shipping label for the first package at a first label printer;

applying the first shipping label using a first label applicator to a first side of the first package based on the orientation of the first package in the labeling station;

printing a first customer specific label for the first package at a second label printer;

applying the first customer specific label using a second label applicator to a second side of the first package based on the orientation of the first package in the labeling station;

removing the first package from the labeling station;

locating the second package in the labeling station;

identifying an orientation of the second package in the labeling station using the scanning device by determining a side of the second package on which a second identification tag is located;

printing a second customer specific label for the second package at the first label printer;

applying the second customer specific label using the first label applicator to a first side of the second package based on the orientation of the second package in the labeling station;

printing a second shipping label for the second package at the second label printer;

applying the second shipping label using the second label applicator to a second side of the second package based on the orientation of the second package in the labeling station.

13. The method of claim 12, further comprising printing a third customer specific label for the first package at the second label printer;

applying the third customer specific label using the second label applicator to a third side of the first package based on the orientation of the first package in the labeling station;

printing a fourth customer specific label for the second package at the first label printer; and applying the fourth customer specific label using the first label applicator to a third side of the second package based on the orientation of the second package in the labeling station.

14. The method of claim 12, wherein said identifying the orientation of the first package comprises imaging multiple sides of the package to determine which of the sides of the first package that includes the first identification tag using the scanning device and wherein said identifying the orientation of the second package comprises imaging multiple sides of the package to determine which of the sides of the second package that includes the second identification tag using the scanning device.

15. The method of claim 14, wherein said applying the first shipping label and said applying the first customer specific label comprise applying the first shipping label and the first customer specific label to different sides of the first package than the first identification tag, and wherein said applying the second shipping label and said applying the second customer specific label comprise applying the second shipping label and the second customer specific label to different sides of the second package than the second identification tag.

16. The method of claim 12, further comprising:

determining a size and a shape of the first package using the scanning device;

determining a size and a shape of the second package using the scanning device;

operating the first label applicator based on the determined size and the determined shape of the first package; and operating the second label applicator based on the determined size and the determined shape of the second package.

17. The method of claim 12, wherein said locating the first package comprises loading the first package against a stop gate at the labeling station, and wherein said locating the second package comprises loading the second package against the stop gate at the labeling station.

18. The method of claim 12, wherein the first label applicator includes a multi-axis robot having a first end effector and wherein the second label applicator includes a multi-axis robot having a second end effector, the method further comprising:

picking the first shipping label from the first label printer using the first end effector;

transporting the first shipping label from the first label printer to the first side of the first package;

pressing the first shipping label against the first side of the first package using the first end effector;

picking the first customer specific label from the second label printer using the second end effector;

transporting the first customer specific label from the second label printer to the second side of the first package;

pressing the first customer specific label against the second side of the first package using the second end effector;

picking the second customer specific label from the first label printer using the first end effector;

transporting the second customer specific label from the first label printer to the first side of the second package;

pressing the second customer specific label against the first side of the second package using the first end effector;

picking the second shipping label from the second label printer using the second end effector;

transporting the second shipping label from the second label printer to the second side of the second package;

pressing the second shipping label against the second side of the second package using the second end effector.

19. The method of claim 12, wherein the first label applicator is a right side label applicator positioned at a right side of the labeling station and the second label applicator is a left side label applicator positioned at a left side of the labeling station, the right side label applicator being capable of applying labels to a right side, a front side, a rear side, and a top side of the package but not a left side of the package, the left side label applicator being capable of applying labels to the left side, the front side, the rear side, and the top side of the package but not the right side of the package;

said applying the first shipping label comprises applying the first shipping label to one of the right side, the front side, the rear side, and the top side of the first package but not the left side of the first package;

said applying the first customer specific label comprises applying the first customer specific label to one of the left side, the front side, the rear side, and the top side of the first package but not the right side of the first package and not the same side to which the first shipping label is applied;

said applying the second customer specific label comprises applying the second customer specific label to one of the right side, the front side, the rear side, and the top side of the second package but not the left side of the second package;

said applying the second shipping label comprises applying the second shipping label to one of the left side, the front side, the rear side, and the top side of the second package but not the right side of the second package and not the same side to which the second customer specific label is applied.

20. The method of claim 12, wherein said applying the first customer specific label comprises applying the first customer specific label based on the location on the first package to which the first shipping label is applied, and wherein said applying the second shipping label comprises applying the second shipping label based on the location on the second package to which the second customer specific label is applied.

* * * * *